US005717766A

United States Patent [19]

Azoulay et al.

[11] Patent Number: 5,717,766

[45] Date of Patent: Feb. 10, 1998

[54] STEREOPHONIC SOUND REPRODUCTION APPARATUS USING A PLURALITY OF LOUDSPEAKERS IN EACH CHANNEL

[75] Inventors: Alain Azoulay, Bâtiment A2 "La Source" -Avenue William Booth, 13011 Marseille, France; Jean-Louis Queri, 24, Rue Viret, 69100 Lyon, France

[73] Assignees: Alain Azoulay, Marseilles; Jean-Louis Queri, Lyons; Jean Rouch, Tassin La Demi Lune, all of France

[21] Appl. No.: 360,722

[22] PCT Filed: Jun. 11, 1993

[86] PCT No.: PCT/FR93/00558

§ 371 Date: May 30, 1995

§ 102(e) Date: May 30, 1995

[87] PCT Pub. No.: WO93/26134

PCT Pub. Date: Dec. 23, 1994

[30] Foreign Application Priority Data

Jun. 12, 1992 [FR] France ..... 92 07447

[51] Int. Cl.[6] ..... H04R 5/00

[52] U.S. Cl. ..... 381/24; 381/182; 381/28

[58] Field of Search ..... 381/24, 82, 85, 381/80, 77, 28, 120, 1, 81, 90, 182, 89

[56] References Cited

U.S. PATENT DOCUMENTS

| | | | |
|---|---|---|---|
| 4,105,864 | 8/1978 | Berkovitz . | |
| 4,107,461 | 8/1978 | Bose | 381/24 |
| 4,199,657 | 4/1980 | Lane | 381/24 |
| 4,472,834 | 9/1984 | Yamamuro et al. . | |
| 4,481,660 | 11/1984 | De Koning et al. | 381/85 |
| 4,598,418 | 7/1986 | Griffith, Jr. et al. | 381/85 |
| 4,683,591 | 7/1987 | Dawson et al. | 381/85 |
| 4,998,283 | 3/1991 | Nishida et al. | 381/90 |
| 5,004,067 | 4/1991 | Patronis | 381/182 |
| 5,233,664 | 8/1993 | Yanagawa et al. | 381/97 |

FOREIGN PATENT DOCUMENTS

| | | |
|---|---|---|
| 0034844 | 9/1981 | European Pat. Off. . |
| 2441978 | 6/1980 | France . |

OTHER PUBLICATIONS

Tremaine, Audio Cyclopedia., 1969, pp. 1153–1156.

Electronic Components And Applications, vol. 5, No. 4, Sep. 1983, Eindhoven NL, pp. 200–206, W.J.W. Kitzen, "Multiple Loudspeaker Array Using Bessel Coefficients".

Journal of the Audio Engineering Society, vol. 38, No. 4, Apr. 1990, New York, U.S., pp. 204–220, M.R. Gander and J.M. Eargle, "Measurement And Estimation Of Large Loudspeaker Array Performance".

*Primary Examiner*—Curtis Kuntz
*Assistant Examiner*—Ping W. Lee
*Attorney, Agent, or Firm*—Dvorak & Orum

[57] ABSTRACT

The present invention relates to sound reproduction apparatus comprising stereophonic amplifier means for amplifying left and right signals from any stereo emission source, and a plurality of loudspeakers disposed in two groups, namely one group on the left of a listening direction and another group on the right thereof, each group respectively receiving the amplified left signal and the amplified right signal. The number of said loudspeakers is even and not less than four, the loudspeakers being situated in pairs on axes that are vertical or substantially vertical, with all of the emission faces of said loudspeakers being placed on a surface of continuous curvature, and with the respective vertical and horizontal distances between said loudspeakers being determined as a function of the size of the loudspeakers and as a function of the listening volume.

6 Claims, 3 Drawing Sheets

STEREOPHONIC SOUND REPRODUCTION APPARATUS USING A PLURALITY OF LOUDSPEAKERS IN EACH CHANNEL

DESCRIPTION

The present invention relates to sound reproduction apparatus using multiple amplifiers.

The technical field of the invention is the field of manufacturing high fidelity equipment for reproducing any sound signal.

One of the main applications of the invention is generating three-dimensional sounds that reconstitute the notion of vertical low and high in the sound message.

BACKGROUND OF THE INVENTION

Numerous sound reproduction apparatuses are known and they always comprise a stage for amplifying a signal coming from some emission source such as a microphone, a magnetic tape, a disk, etc. . . . , together with one or more loudspeaker enclosures containing one or more loudspeakers transforming the amplifier output signals into membrane vibrations, thereby creating variations in sound pressure waves.

In order to enable such reproduction to be as true as possible compared with the quality of the original source, and in order to have a sound level that is sufficiently audible throughout an auditorium in which said reproduction is taking place, various different kinds of equipment have been developed:

to reproduce the three-dimensional effect, stereophonic methods are known both for recording and for playing back that serve to provide an impression of sound perspective in contrast to monophonic recording, by using at least two separate loudspeakers, each of which reproduces only a portion of the sound signal; for the same purpose, mention can be made of tetraphonic or quadraphonic techniques that made use of four channels; in all of those techniques, each channel is distinct and separate all the way from the playback emission source to each corresponding group of loudspeakers;

to reproduce the largest possible passband, a plurality of loudspeakers have been combined on each of said output channels within a common acoustic enclosure, each loudspeaker being adapted to an optimum and often-narrow waveband, and the set of speakers being complementary so as to cover the entire audible range, such that in general there can be found at least one low frequency loudspeaker for the base, a high frequency speaker for the treble, and a medium frequency speaker for mid-range. Each enclosure thus receives an overall signal which is reproduced with high efficiency by each of the speakers it contains within the optimum frequency range thereof: however, if it is desired to make modifications to playback at amplifier level by increasing or decreasing the emitted power, then each loudspeaker responds to such a correction in differing manner, so it is necessary simultaneously to correct their frequency ranges relative to one another; it is therefore the practice to act on filter systems which in fact modify the entire signal, thereby giving to rise to distortion and to phase shifts that spoil the original sound quality (Fletcher type equalization curves).

To avoid such phenomena, some manufacturers propose making adjustments at the input of each loudspeaker within a loudspeaker enclosure, but that does not avoid frequency separation filters that disturb reproduction.

Since the soundwaves are emitted from each loudspeaker which is a point source within the surrounding volume, they are subject to three-dimensional dilution within a sphere, i.e. they diminish with the square of distance, so to make it possible to achieve an adequate listening sound level, in addition to the need for a signal amplifier, loudspeakers are also provided with conical horns of regular or exponential shape for better directional effect, the horns surrounding the vibrating membrane so as to concentrate emission power towards the front of the loudspeaker; however there is always a lateral diffusion gradient and sound volume always increases very significantly with distance. Such directivity also limits the listening volume and can give rise to echo phenomena by reflection of the waves on room walls. In addition, when using a microphone, depending on the position of the microphone, there can occur an amplified feedback effect between the loudspeakers and the microphone, which reverberation effect is most disagreeable and inconvenient.

Thus, if it is desired to listen to such equipment under the best possible conditions, it is necessary to position the amplifiers and the loudspeaker enclosures in their optimum operating positions, and then to position oneself at a given angle at a maximum distance from the loudspeaker enclosures so as to avoid forcing deafening oneself and loosing the stereophonic three-dimensional effect, and in addition, it is necessary to place oneself at equal distance from the loudspeaker enclosures, each of which receives one of the channels, in order to preserve the perspective effect: this limits listening to having a listener in a small zone that is limited laterally, vertically, and in depth, and with any given high fidelity equipment, the further one is from said rather restrained zone, the less excellent the quality of reproduction.

It is true that various developments seek to improve reproduction quality and listening volume, with some such attempts constituting the subject matter of patent applications, e.g. the application made by Mr. Bour for "Omnidirectional Loudspeaker Enclosures", No. FR 2 572 237 published on Apr. 25, 1986, or the application by Mr. C. Carpentier for "Stereophonic Sound Production Apparatus for a Car", No. FR 2 599 581 published on Dec. 4, 1987, or indeed the application in the name of the firm Electronique Industrielle de Moulins, for a "Three-phase Sound Reproduction System", No. EP 15 186, published on Sep. 3, 1980.

In addition, publications can be found describing arrangements of loudspeakers disposed in regular manner horizontally and vertically so as to constitute plane matrices, which loudspeakers are associated with various amplifier equipments and power measuring equipments for the purpose of improving the sound delivered thereby: by way of example, mention can be made of the publication Electronic Components and Applications, Vol. 5, No. 4, September 1983, published in Eindhoven, the Netherlands, carrying on pages 200 to 205 thereof an article by Mr. Kitzen entitled "Multiple loudspeaker array using Bessel coefficients" in which in order to compensate for the distortions of power increasing as a function of frequency, as mentioned above, each emission power of each loudspeaker is adjusted so as to flatten the power coefficient as much as possible by using "Bessel" weighting for fixed and constant coefficients by connecting loudspeaker coils in series or in parallel; in addition, it is stated that to obtain the desired effect at a distance that is as close as possible to the loudspeakers themselves, it is recommended to clamp the loudspeaker enclosure against one another without any intermediate gaps.

In another publication "Journal of the Audio Engineering Society", Vol. 38, No. 4, April 1990, New York, U.S.A., an article by Mr. Gander and Mr. Eargle and entitled "Measurement and estimation of large loudspeaker array performance", the performance of loudspeakers disposed in enclosures in different positions relative to one another is measured and estimated specifically so as to optimize such positioning on the basis of free-field measurements, associated with a reflecting ground and minimizing edge effects, and there is also described the use of software for optimizing such dispositions. However that article relates to loudspeaker enclosures being used as such in concert halls of arbitrary shape and size as a function of the location from which it is desired to emit the sound, without putting into question either the loudspeaker enclosures themselves or the signals that they deliver.

Depending on applications and on listening positions, such systems doubtless provide some improvement, however, they are not capable in any event either of covering a large listening area, except by supplying excessive power, nor of obtaining good reproduction at all frequencies.

OBJECT AND SUMMARY OF THE INVENTION

The problem posed is thus firstly to enable sound reproduction to be listened to at satisfactory level throughout a large listening volume without the stereophonic effect being filtered, and without requiring excessive amplification, such that a single setting gives a good listening level throughout the listening range, and secondly to provide said reproduction over the entire frequency range of the original sound, while conserving its perspective, its tonality, and its three-dimensional effect, without phase-shifting or distortion or background noise.

A solution to the problem posed is a sound reproduction apparatus comprising stereophonic amplifier means on the basis of two signals, namely a left signal and a right signal, coming from any stereophonic emission source, and a plurality of loudspeakers disposed in two groups relative to a listening direction, namely a left group and a right group, the groups respectively receiving the amplified left signal and the amplified right signal, the set of said loudspeakers being even in number, and equal to not less than four, all of the emission faces of said loudspeakers being placed in a surface of continuous curvature, wherein said loudspeakers are situated in pairs on vertical or substantially vertical axes, and the respective distances vertically and horizontally between said loudspeakers are determined as a function of the dimensions thereof and of the dimensions of the listening volume, and each loudspeaker is associated with its own amplifier which applies to said loudspeaker all of the signal frequencies received, said signals being previously subdivided into as many paths as there are loudspeakers by means of a distributor.

In a preferred embodiment, prior to said distributor, the apparatus of the invention includes a modulator which, after integrating the signal as received from the emission source (either for each signal, or preferably for the overall signal), firstly distributes the signal over each output path of the distributor as a function of pre-established thresholds for opening one or more of said outputs, and secondly, modulates the amplification of each of the signals addressed thereto as a function of said overall signal without phase-shifting and without frequency processing the signal, i.e. ensuring that the phase and the frequencies of the overall emission signal are maintained.

In a preferred embodiment, in order to reinforce the plane propagation effect of the waves as explained below, said sound reproduction apparatus of the invention includes eight loudspeakers disposed in two groups of four, i.e. four to the left and four to the right, each group forming a four-pole network or "quadripole", and the two groups being placed systematically about a midplane.

Preferably, all of said loudspeakers are identical and they are chosen to respond to a frequency band lying in the range about 100 Hz to about $10^4$ Hz. Such loudspeakers, may, for example, of a medium type having a diameter of about 13 cm.

The result is novel sound reproduction apparatuses satisfying the problem posed and avoiding the drawbacks of previously known systems.

The quadripole system makes it possible to distribute sound pressure waves in uniform manner in application of a plane gradient parallel to the surface of continuous curvature as defined by the disposition of the emission faces of the loudspeakers: in a normal system, there is a pressure gradient which is spherical and thus transversal in all directions, thereby diluting the pressure wave in the three axial directions. In the quadripole system, the gradient diminishes only in the direction perpendicular to the emission surface.

There does indeed exist a gradient effect that reverts to being spherical at the periphery of said surface, but if the array of said loudspeakers in quadripoles is multiplied to constitute an infinite array, then a soundwave would be obtained that is plane without any lateral gradient; this would apply, for example, in a room in which the walls, the ceiling, and the floor are used as mirrors for distributing the loudspeakers over the entire area of one of the walls, in accordance with the invention, and at a distance that is equal to half the distance between the speakers for the loudspeakers situated at the edges relative to adjacent walls.

In any event, in the main direction which is perpendicular to the emission surface, which surface can be referred to as a "sound wall", power decreases solely in inverse proportion to said distance instead of being inversely proportional to the square thereof: thus, for a given distance, emission power of a few watts will give the same result as emission power of several hundreds of watts as required with sound reproduction apparatus of the kind that exists at present, using individual loudspeakers or enclosures each housing few loudspeakers. When people listening to the reproduction move about, the effect of sound diminishing will be much less perceptible on moving away from the emission surface because of the small decrease in power. Thus, in addition to making it possible to cover a much larger volume while providing good sound quality, the present invention also avoids the significant distortion that is always produced by the excessive signal amplification performed using present day equipment, and indeed it avoids feedback effects with microphones, if any, also known as "howl-around".

In addition, a better stereophonic effect is obtained since with presently known systems using two loudspeaker enclosures, even when each enclosure contains a plurality of loudspeakers, each enclosure acts as a single sound source: the optimum amplitude is thus achieved only in the midplane perpendicular to the line interconnecting said enclosures, whereas with a quadripole system of the invention, substantially uniform amplitude is obtained over all surfaces parallel to the emission surface having said four loudspeakers or quadripoles, thereby giving rise to optimum listening throughout the volume situated in front of said emission surface.

In addition, the uniform equal-pressure zone created in this way by said emission surface reduces the feedback from rooms in which listening takes place, since all of the air molecules in the room are excited in the same manner, whereas point-source emission from conventional loudspeakers or loudspeaker enclosures can give rise to reflected sound that is of greater amplitude than the incident sound which is directional at a given location, and if what happens to be on one side of the emission direction from the loudspeaker enclosures and from the loudspeakers, then there is an echo effect and thus a loss of intelligibility. In the context of the present invention, the directional sound is always greater than the reflected sound throughout the room because of the plane wave, thus making better listening possible and eliminating any disturbing echo phenomenon.

As mentioned before, because of the smaller power applied to each loudspeaker for the same listening sound power at a given point, i.e. power that is about four times smaller at least, each loudspeaker operates over a better power range; since its back electromotive motor force (back-emf) is also lower, it has less effect on the output of the amplifier: there is less distortion of the signal and thus better efficiency. On the contrary, in presently available systems, a "power race" can be observed, and that is made all the more ridiculous because energy is lost specifically in the back emf which gives rise to the distortion.

It may also be observed that the quadripole gives rise to an altitude effect by the fact of having the loudspeakers organized as vertical two-pole systems whereas in a conventional system the loudspeakers occupy a single horizontal plane, in general at ear height; loudspeaker enclosures behave in the same way since they are constituted by assemblies of loudspeakers operating over different frequency ranges and they therefore behave like point sources, so unless one is on the axis of such an enclosure or of such a loudspeaker, quality is lost from at least one of the frequency ranges.

The volume of air set into motion also reduces the effects of obstacles, particularly when one remains in direct line of sight of a loudspeaker, and the plane soundwave effect makes it possible for the wave to pass round obstacles without being disturbed; it even happens that better sound directivity is obtained in the treble (i.e. above 4000 Hz to 5000 Hz) because of an air molecule backscattering effect, even behind a "sound wall".

The dynamic distribution of paths in real time over the quadripole also makes it possible to reinforce the natural dynamic range by a physical effect due to the change in emission mode as described below which makes it possible, in the apparatus of the invention, to switch from emitting cylindrical waves to emitting a plane wave.

Finally, compared with present-day multi-path loudspeaker enclosures in which use filters to direct different frequencies to specialized loudspeakers, the signal distributor modulator system of the invention makes use of an active multi-amplifier system without phase-shifting, and all of the loudspeakers receive all of the frequencies: treatment is thus with respect to energy only and not with respect to frequency; there is therefore no longer any need to provide multi-path loudspeaker enclosures, and mid-range loudspeakers suffice, as defined below.

Other advantages of the present invention could be mentioned, but those mentioned above already suffice to show the novelty and the advantage of the invention.

BRIEF DESCRIPTION OF THE DRAWINGS

The following description and figures represent an embodiment of the invention but they are not limiting in any way: other embodiments are possible in the ambit of the scope and the extend of the present invention.

MORE DETAILED DESCRIPTION

Figure 1:
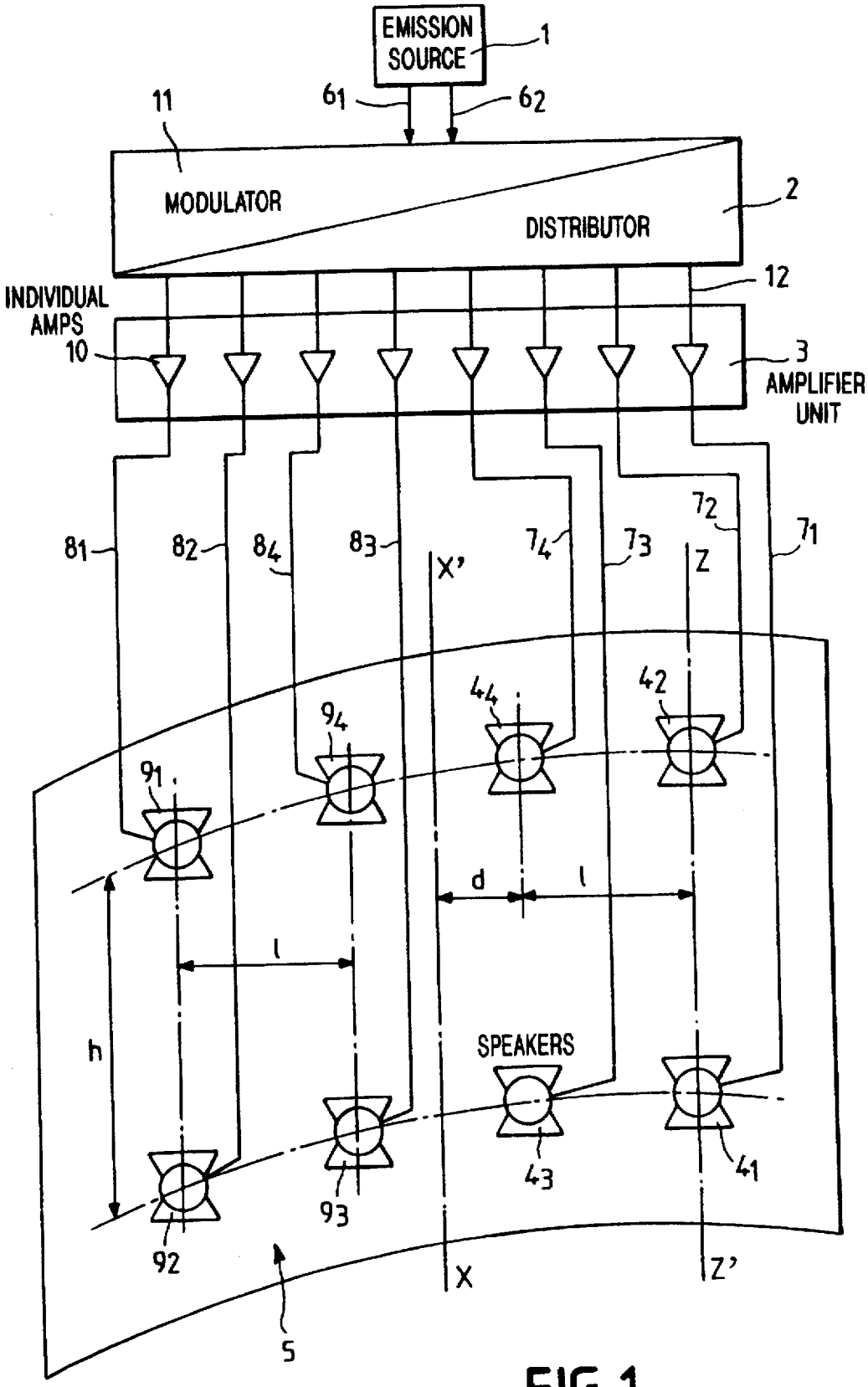
FIG. 1 is a diagrammatic overall view of apparatus of the invention.

FIG. 1 shows said sound reproduction apparatus of the invention which comprises, in known manner: stereophonic amplifier means 3 amplifying signals $6_1$ and $6_2$ referred to as "left" and "right" signals that come from any appropriate stereo emission source 1, and a plurality of loudspeakers 4, 9 disposed in two groups relative to the listening direction: a "left" group 9 and a "right" group 4; each of the groups receiving a respective amplifier "left" signal 8 or "right" signal 7.

In the present invention, one of the important and essential characteristics is that the number of loudspeakers 4, 9 in said set is even, and not less than four, and the speakers are situated in pairs on axes zz' that are vertical or substantially vertical, and all the emission faces of said loudspeakers 4, 9 lie on a surface 5 of continuous curvature: the respective distances between the loudspeakers 4, 9 in both height h, and in width l and d are determined as a function of the sizes of the speakers and the listening volume.

In FIG. 1, the apparatus comprises eight loudspeakers disposed in two groups of four, four to the left, 9, and four to the right, 4, each group forming a quadripole that is placed symmetrically about a midplane xx'; by way of example and in one particular embodiment, the height h between loudspeakers in each of the quadripoles is equal to twice the distance l between them, and the distance d between each quadripole and the middle axis xx' may be equal to ½l.

The surface of continuous curvature 5 can be any convex or concave curved surface.

Figure 1A:
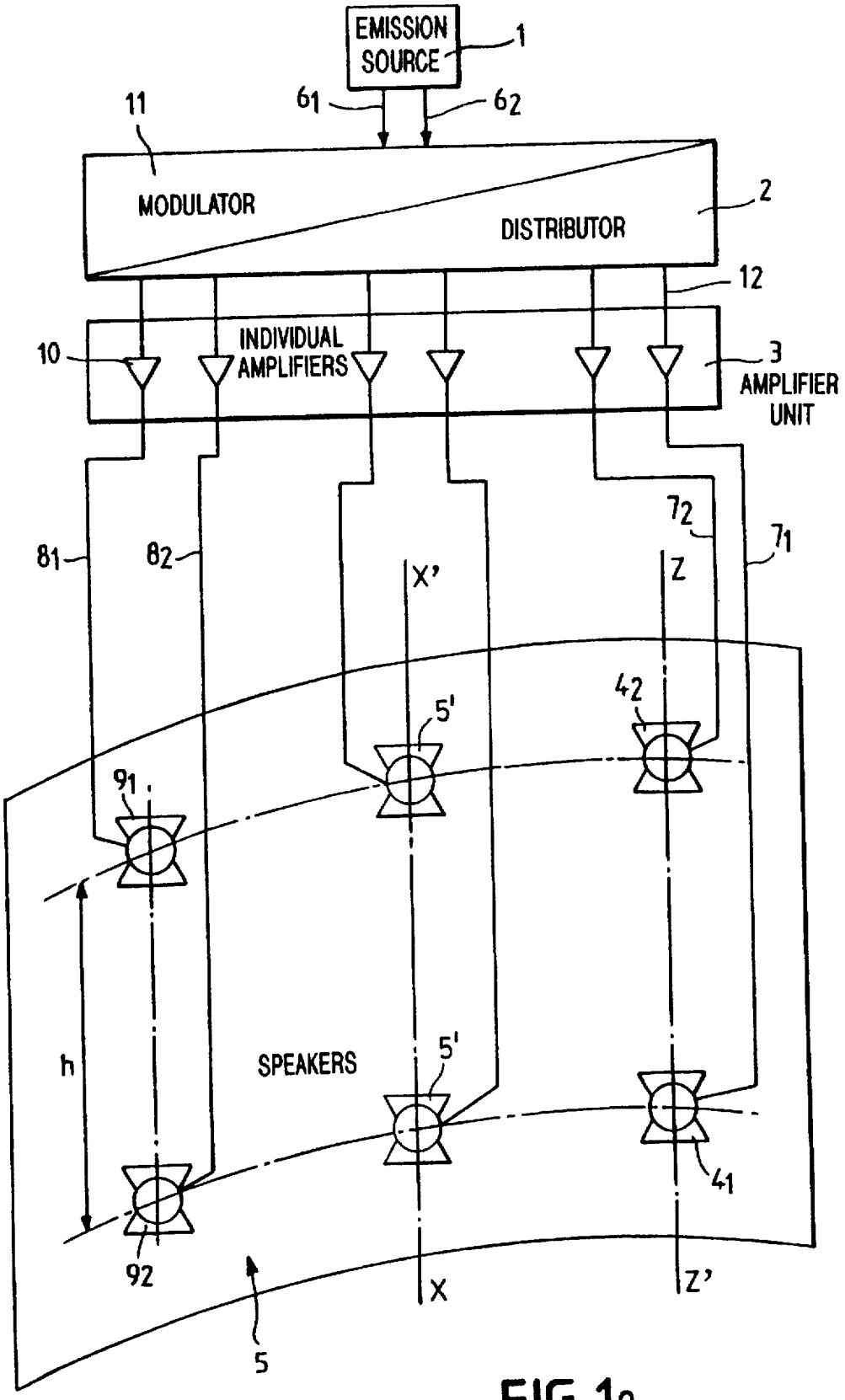

In FIG. 1A, in another embodiment, the apparatus of the invention may comprise six loudspeakers, including two left side speakers 9 and two right side speakers 4 that respectively receive the left and right signals 8 and 7 corresponding thereto, plus two central speakers situated at equal distance d from the two side groups and receiving both left and right signals.

Said loudspeakers, both in the right group 4 and in the left group 9 are preferably all identical and they are chosen so as to have a response frequency range lying between about 100 Hz and about $10^4$ Hz, which means in practice loudspeakers having a disk-shaped emission face with a diameter of about 13 cm.

Such loudspeakers are of the "mid-range" type and they are generally to be found in present day multi-path loudspeaker enclosures, however for reproduction of bass and treble sounds they are associated with specialized loudspeakers since their own response curves are poor in those ranges. In presently known loudspeaker enclosures, it is thus the practice to add a low frequency loudspeaker and a high frequency loudspeaker so as to fill out and thus extend the ends of the emission curve of the mid-range loudspeaker by increasing and reinforcing solely the bass and the treble ranges for each of said loudspeakers respectively: however that requires filtering and the various impedances thereof give rise to distortion and to phase-shifting. Such a combination is necessary because of the way in which spherical waves lose power, particularly with respect to bass frequencies around each loudspeaker, whereas in apparatus of the present invention, a soundwave field is obtained that occupies surfaces having parallel continuous curvature, and that are preferably planar; GENUINE superposition thus occurs therein of the emission from each of the loudspeakers in a combination, that is not in frequency, but that is in a given geometrical disposition, thereby maintaining the emission curve of each loudspeaker without attenuation, and even lifting the ends of the overall emission curve, particularly towards the bass; at the bass end, emission is indeed more spherical than in the mid-range where directivity is greater, and than in the treble range which is even more directional and in which the plane wave effect is of less significance.

Figure 2:
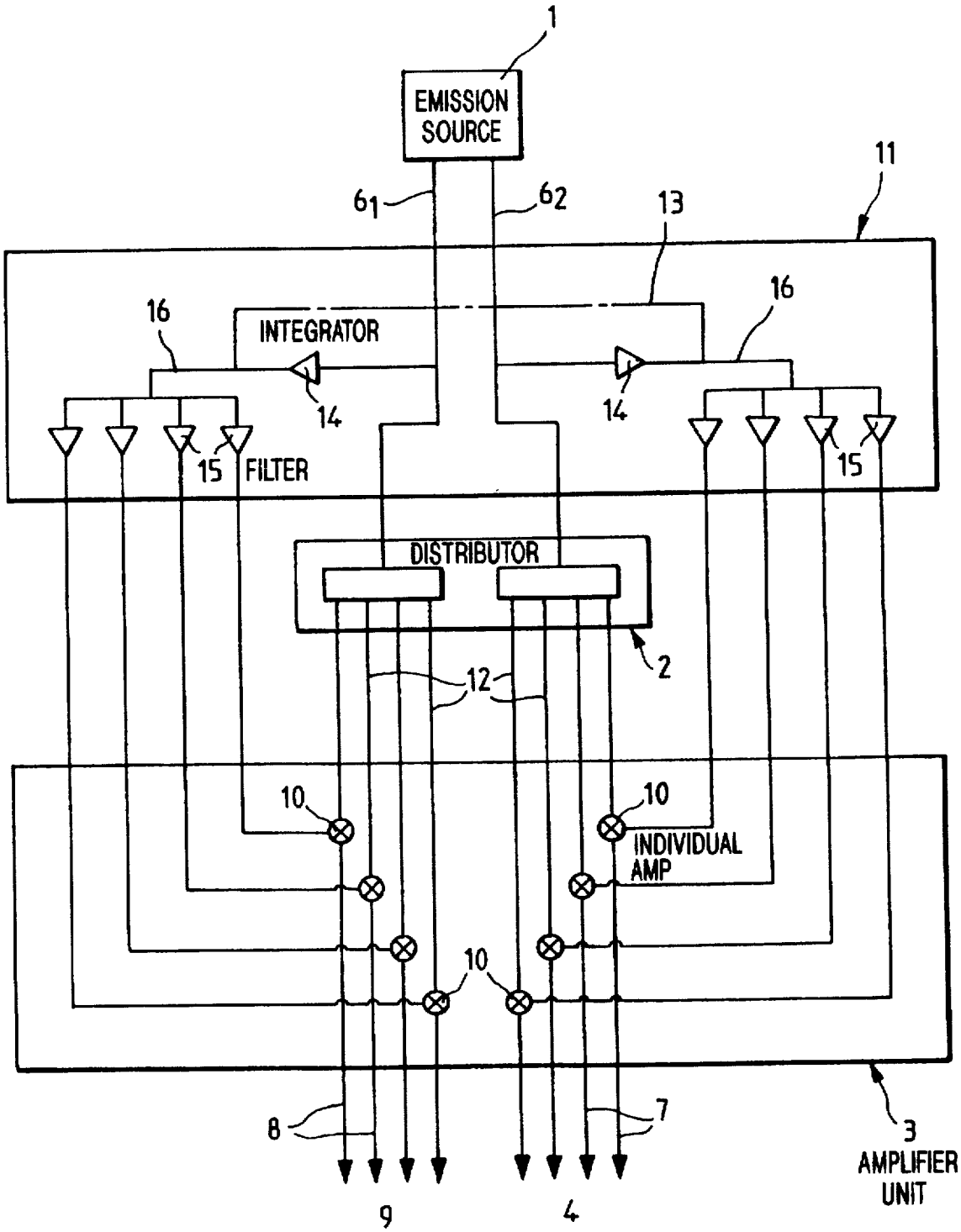
FIG. 2 is a wiring diagram of a portion of the FIG. 1 apparatus, corresponding to elements that make active multiple amplification of the signals possible.

Each loudspeaker $4_1$, $4_2$, $4_3$, $4_4$ and $9_1$, $9_2$, $9_3$, $9_4$, etc. in the above set of quadripoles is associated with other quadripoles so as to build up an even larger emission surface, is associated with its own amplifier 10 constituting a portion of said amplification means 3, which amplifier delivers thereto all of the frequencies in the received signal, said signal being previously subdivided by a distributor 2 into as many paths 12 as there are loudspeakers: in parallel with said distributor 2, the apparatus of the invention may include a modulator 11, as described with reference to FIG. 2 below.

FIG. 2 is a wiring diagram for a portion of the apparatus corresponding to the elements for providing multiple active amplification of the signals $6_1$, $6_2$ and which constitutes another important characteristic of the present invention: for each channel (left and right), the modulator 11 makes is possible to integrate at least the signal 6 corresponding to said channel coming from the emission source 1, by means of an integrator 14 connected in parallel with each of said channels, thereby providing both decoupling and said integration. Thereafter, said modulator 11 comprises control preamplifiers 15 with filters that distribute said integrated signal 16 over each output 12 of the paths from the distributor 2 that correspond to the loudspeakers of the same channel: this distribution is performed as a function of pre-established thresholds for the purpose of opening one or more of said outputs 12, and of modulating the amplification of each of said original signals $6_1$ or $6_2$ addressed thereto as a function of the integrated overall level of said signal, while not disturbing the phase or the frequencies thereof.

In another embodiment, said modulator integrates all of the left and right signals by means of a link 13 between the channels $6_1$ and $6_2$ after the preamplifiers and integrators 14 for each of said channels: the overall signal integrated in this way is then processed by the control preamplifiers with filters 15 which thus open at given levels as a function of pre-established thresholds of the overall signal as described above, when using only a portion of the signal or all of the right signal or all of the left signal: depending on circumstances, amplification of each of the signals applied to each output 12 is modulated as a function of the overall left and right signals.

In another embodiment, not shown in FIG. 2, in addition to the amplification stages 3 as represented by amplifiers 10 on each path to a loudspeaker 7 or 8 and as controlled by the modulator 11, it is possible to include after said outputs 7, 8 and before the corresponding loudspeakers 4, 9, another amplification stage capable of being adjusted by any operator seeking to modulate the overall amplification of the emission by any external, known means.

Thus, the dynamic distribution of the paths in real time over each of the quadripoles makes it possible to reinforce the natural dynamic range by a physical effect obtained by changing emission mode, thereby making it possible to pass and send power solely to one, two, or four of the loudspeakers in each quadripole: this makes it possible to switch between a spherical wave and a cylindrical wave and then to a quasi-plane wave, using the same emitted energy at any give instant, with switching from one mode to another being performed in application of a continuous overlap relationship defined by the control and switchover thresholds, which are adjusted, in particular, so as to obtain substantially constant power per $m^2$ for each loudspeaker.

In addition, this active multi-amplifier system is implemented without phase-shifting between the loudspeaker enclosures and without applying frequency treatments to the left and right signals: the signals transmitted by each loudspeaker continues to be a true scale image without deformation, the frequency spectrum emitted by each loudspeaker being the same as that emitted by the corresponding paths $6_1$, $6_2$ of the channel coming from the emission of the source 1.

The integrator 14 makes it possible to obtain an output signal SO on a parallel path 16 having the following value, where R and I respectively represent resistance and current:

$$SO = \int_0^{t1} RI^2 \times dt$$

from the corresponding signal 6 during given time t1, and said integrated value SO is distributed over each of the treatment input 15 which, by modulating the commands as a function of the thresholds of said signal SO, thereby makes it possible to open and direct the sound to each amplifier and multiplier 10 for each loudspeaker so as to open one, two, four, or more loudspeakers for extra or for reduced amplification as a function of the number of thresholds that have been set.

The purpose of distributing sound in this way and of amplifying it in this way is to ensure that the equivalent emission sound surface relative to energy is as follows:

$$S_{effective} = \left(SO\,P - \frac{}{Pnominal}\right)$$

and is constant regardless of the number of loudspeakers in operations: this thus provides a new manner of amplifying sound by modulating an emission surface as a function of power.

We claim:

1. A sound reproduction apparatus for reproducing a signal frequency from a stereophonic emission source relative to a listening direction, said signal frequency defined by a band of frequencies generally ranging from 100 Hz to $10^4$ Hz, said source producing a left signal and a right signal, each of said signals being equal in composition of said frequency band, said apparatus comprising:

a plurality of stereophonic loud speakers comprised of eight loudspeakers disposed into a left group and a right group relative to said listening direction, each of said groups provided with four speakers, thereby forming a respective left and right quadripole, wherein said loudspeakers are all identical in dimensional size and are selected to have a frequency response range lying between about 100 Hz and about $10^4$ Hz, each of said loudspeakers having an exacting emission face defined by a lateral length and a vertical length and all of said loudspeakers within said left and right groups arranged such that said emission faces collectively form an imaginary emission surface of continuous curvature, said imaginary emission surface including a vertical midplane axis, each of said speaker groups being symmetrically arranged in vertically aligned speaker pairs along a respective left group and right group vertical speaker pair axes, said speaker pair axes within each speaker group parallely arranged with respect to each other and to said midplane axis such that each of said speaker pairs within said speaker groups are disposed an equal and lateral distance from each other and wherein each of said speaker groups is disposed an equal and lateral distance from said midplane axis and the height between respective loudspeaker pairs within each respective said speaker group is equal to twice a distance between said speaker pair axes, and wherein the distance between each speaker group and the midplane axis is equal to one-half the same distance between said speaker pair axes;

a plurality of amplifiers for amplifying said signal frequency, one amplifier matched to each loudspeaker, each amplifier amplifying said signal frequency received by said respective loudspeaker, all of said speakers amplifying said entire frequency band;

a modulator for integrating the left signal and the right signal received from the emission source by first distributing each of said signals over each of the path outputs of the distributor as a function of pre-established thresholds to open one or more of said outputs, and secondly to modulate the amplification of each of the signals addressed thereto as a function of said signal, while ensuring that the phase and the frequency thereof remain unchanged;

a frequency signal distributor disposed between said emission source and said amplifiers, said distributor having an input path for receiving said left and right signals and a plurality of output paths for distributing all of said signal frequencies received from said source to said loudspeakers, said distributor having one outlet path for each respective said loudspeaker within said left and right groups.

2. The sound reproduction apparatus of claim 1, wherein the imaginary emission plane causes a distribution of outputted sound pressure waves being emitted from said loudspeakers in a uniform and parallel manner with respect to said imaginary plane such that a diminishing pressure gradient is only created in a direction perpendicular to said emission faces of said loudspeakers.

3. The sound reproduction apparatus of claim 2, wherein said pressure of said outputted sound waves is represented by a power energy value as $$SO = \int_0^{t_1} R I^2 \, dt,$$

where R is resistance and I is amperage, said power decreasing in inverse proportion to a distance away from said speakers.

4. The sound reproduction apparatus for claim 3, wherein the loudspeaker signal frequencies are unfiltered before being amplified.

5. The sound reproduction apparatus of claim 2, wherein said uniform pressure gradient creates a uniform signal frequency amplitude across said imaginary emission plane, thereby reducing feedback and echoing phenomenon.

6. A sound reproduction apparatus for reproducing a signal frequency from a stereophonic emission source relative to a listening direction, said signal frequency defined by a band of frequencies generally ranging between 100 Hz to $10^4$ Hz, said source producing a left signal and a right signal, each of said signals being equal in composition of said frequency band, said apparatus comprising:

a plurality of stereophonic loud speakers comprised of six loudspeakers disposed into a left side group, a right side group and a central group relative to said listening direction, said left side group having two left side speakers and said right side group having two right side speakers, each of said left and right side speaker groups respectively receiving the left signal and the right signal corresponding thereto, said central group having two speakers situated at equal distances from the two side groups, and receiving both the left signal and the right signal, wherein said loudspeakers are all identical in dimensional size and are selected to have a frequency response range lying between about 100 Hz and about $10^4$ Hz, each of said loudspeakers having an exacting emission face defined by a lateral length and a vertical length and all of said loudspeakers within said left and right groups arranged such that said emission faces collectively form an imaginary emission surface of continuous curvature, and said imaginary emission surface including a vertical midplane axis, each of said speaker groups being respectively arranged in vertically aligned speaker pairs along a respective left group and right group vertical speaker pair axes, said speaker pair axes within each speaker group parallely arranged with respect to each other and to said midplane axes such that each of said speaker pairs within said speaker groups are disposed an equal and lateral distance from each other and wherein each of said speaker groups is disposed an equal and lateral distance from said midplane axis and the height between respective loudspeaker pairs within each respective said speaker group is equal to twice a distance between said speaker pair axes, and wherein the distance between each speaker group and the midplane axis is equal to one-half the same distance between said speaker pair axes;

a plurality of amplifiers for amplifying said signal frequency, one amplifier matched to each loudspeaker, each amplifier amplifying said signal frequency received by said respective loudspeaker, all of said speakers amplifying said entire frequency band;

a modulator for integrating the left signal and the right signal received from the emission source by first distributing each of said signals over each of the path outputs of the distributor as a function of pre-established thresholds to open one or more of said outputs, and secondly to modulate the amplification of each of the signals addressed thereto as a function of said signal, while ensuring that the phase and the frequency thereof remain unchanged;

a frequency signal distributor disposed between said emission source and said amplifiers, said distributor having an input path for receiving said left and right signals and a plurality of output paths for distributing all of said signal frequencies received from said source to said loudspeakers, said distributor having one outlet path for each respective said loudspeaker within said left and right groups.

* * * * *